US009662802B2

(12) United States Patent
Mcfarlane

(10) Patent No.: US 9,662,802 B2
(45) Date of Patent: May 30, 2017

(54) DRUM

(71) Applicant: Brinsley Mcfarlane, Carmichael (GB)

(72) Inventor: Brinsley Mcfarlane, Carmichael (GB)

( * ) Notice: Subject to any disclaimer, the term of this patent is extended or adjusted under 35 U.S.C. 154(b) by 35 days.

(21) Appl. No.: 14/408,419

(22) PCT Filed: Jun. 18, 2013

(86) PCT No.: PCT/GB2013/000271
§ 371 (c)(1),
(2) Date: Dec. 16, 2014

(87) PCT Pub. No.: WO2013/190256
PCT Pub. Date: Dec. 27, 2013

(65) Prior Publication Data

US 2015/0202795 A1 Jul. 23, 2015

(30) Foreign Application Priority Data

Jun. 19, 2012 (GB) ..... 1210804.9

(51) Int. Cl.
*B28C 5/00* (2006.01)
*B28C 5/42* (2006.01)

(52) U.S. Cl.
CPC ..... *B28C 5/4262* (2013.01); *B28C 5/4268* (2013.01)

(58) Field of Classification Search
CPC ..... B01F 15/00785; B01F 15/00779; B28C 5/4262; B28C 5/4269
(Continued)

(56) References Cited

U.S. PATENT DOCUMENTS 2,006,206 A * 6/1935 Ball ..... B01F 15/00785 220/263
2,348,682 A * 5/1944 Jaeger ..... B28C 5/4262 366/54
(Continued)

FOREIGN PATENT DOCUMENTS

EP 1447193 A2 5/2004
EP 1842642 A2 10/2007
(Continued)

OTHER PUBLICATIONS

"International Application Serial No. PCT/GB2013/000271, Internation Search Report Oct. 22, 2013", (Oct. 22, 2013), 4 pgs.
(Continued)

*Primary Examiner* — Tony G Soohoo
*Assistant Examiner* — Anshu Bhatia
(74) *Attorney, Agent, or Firm* — Schwegman Lundberg & Woessner, P.A.

(57) ABSTRACT

An improved drum for a lorry-based concrete mixer is described. The drum comprises a drum body having an edge defining an aperture for permitting access to a drum body interior and a manhole cover hingedly attached to the drum body, the manhole cover being movable from an aperture dosed position, in which the aperture is sealed, to an aperture open position, in which the aperture is open and the drum body interior may be accessed. The drum further comprises at least one locking mechanism adapted to lock the manhole cover In the aperture dosed position, an edge of the manhole cover being trapped between the/each locking mechanism and the drum edge in the aperture closed position. The at least one locking mechanism is adapted to support the manhole cover in a retained position between the aperture dosed position and the aperture open position.

14 Claims, 4 Drawing Sheets

(58) Field of Classification Search
USPC ..... 366/54, 62; 220/810, 820
See application file for complete search history.

(56) References Cited

U.S. PATENT DOCUMENTS

| | | | | |
|---|---|---|---|---|
| 4,657,771 | A * | 4/1987 | Gould | A01J 27/04 426/519 |
| 2002/0071336 | A1 | 6/2002 | Smith | |
| 2011/0058446 | A1* | 3/2011 | Khouri | B01F 9/06 366/62 |

FOREIGN PATENT DOCUMENTS

| | | | | |
|---|---|---|---|---|
| GB | EP 1447193 | A2 * | 8/2004 | B01F 15/00785 |
| JP | 0952225 | A | 2/1997 | |
| WO | WO-2013190256 | A1 | 12/2013 | |

OTHER PUBLICATIONS

"International Application Serial No. PCT/GB2013/000271, Written Opinion Oct. 22, 2013", (Oct. 22, 2013), 6 pgs.

* cited by examiner

DRUM

PRIORITY APPLICATIONS

This application is a U.S. National Stage Filing under 35 U.S.C. §371 from International Application No. PCT/GB2013/000271, filed on 18 Jun. 2013, and published as WO2013/190256 A1 on 27 Dec. 2013, which claims the benefit under 35 U.S.C. §119 to United Kingdome Application No. GB 1210804.9, filed on 19 Jun. 2012; which applications and publication are incorporated herein by reference in their entirety.

FIELD OF THE INVENTION

The present invention relates to an improved drum for a concrete mixer and particularly, but not exclusively, to a drum with improved access.

BACKGROUND TO THE INVENTION

Mobile concrete mixers having a mixer drum mounted on a truck chassis are well-known in the building industry. Such concrete mixers are used to transport liquid concrete (comprising cement, sand and water) from a plant to a building site where the concrete is to be used. The concrete mixer drum is typically mounted at an angle on the truck chassis with the opening of the drum some height above the ground. The drum is rotated in the first direction to draw materials into the drum during transportation to the building site and it includes internal screws or ribs which expel concrete from the drum through the discharge chute when the drum is rotated in the opposite direction.

Access to the interior of the drum is required for cleaning and maintenance purposes. Accordingly, the drums are typically manufactured including a manhole which is closed by a manhole cover that is securely bolted to the drum using, typically, twelve separate bolts. To gain access to the drum interior, an operator must release each of these bolts and remove the manhole cover, before climbing to the manhole. This is a time-consuming process and the weight of the manhole cover is such that it can be a cumbersome operation to remove the manhole cover out of the way of the access into the drum, particularly if the user still holding the tools.

SUMMARY OF THE INVENTION

According to a first aspect of the present invention there is provided an improved drum for a lorry-based concrete mixer, the drum comprising:

a drum body having an edge defining an aperture for permitting access to a drum body interior;

a manhole cover hingedly attached to the drum body, the manhole cover being movable from an aperture closed position, in which the aperture is sealed, to an aperture open position, in which the aperture is open and the drum body interior may be accessed; and at least one locking mechanism adapted to lock the manhole cover in the aperture closed position, an edge of the manhole cover being trapped between the/each locking mechanism and the drum edge in the aperture closed position;

wherein the at least one locking mechanism is adapted to support the manhole cover in a retained position between the aperture closed position and the aperture open position.

In at least one embodiment of the present invention, providing a drum for a lorry-based concrete mixer which incorporates a hinge and at least one locking mechanism allows for the manhole cover to be moved from the aperture closed position to the aperture open position without the possibility of the manhole cover being dropped and potentially damaged. Being able to retain the manhole cover in a position between the aperture closed and open positions allows the user to release the manhole cover and then swing it open in two separate operations.

The manhole cover may be biased to the aperture open position. Providing a manhole cover which is biased to the open position permits access to the interior of the drum more quickly.

The manhole cover may be biased under its own weight. Such an arrangement permits the manhole cover to swing open when it is released by the locking mechanism.

In the manhole cover closed position, the locking mechanisms may compress the manhole cover against the drum edge. Such an arrangement forms a tight seal.

In the retained position, the seal between the manhole cover and the drum edge is broken.

In an embodiment, in moving from the aperture closed position to the manhole cover retained position, the manhole cover moves away from the drum edge in a direction substantially perpendicular to the drum edge. In an embodiment, in moving from the manhole cover retained position to the aperture open position, at least part of the movement is a rotational movement. Particularly, the manhole cover may be rotated to move clear of the/each locking mechanism.

The manhole cover may comprise gripping means. Gripping means are provided to allow the manhole cover to be moved to the aperture open position. The gripping means may be handles.

The manhole cover may be hingedly attached to the drum by means of an arm. The arm may be attached at a first end to the drum body and at a second end to the manhole cover. The manhole cover may be rotationally movable with respect to the other. A rotational movement of the manhole cover, in some embodiments, is required to move the manhole cover from the retained position to the aperture open position.

In an embodiment, a tool is required to release the locking mechanism and allows the manhole cover to move from the aperture closed position to the retained position. In this arrangement, a tool can be used to release the manhole cover to the retained position allowing the operator to put down his tool and then use both hands to rotate the manhole cover such that it is no longer retained and can be swung about the hinge to the aperture open position.

BRIEF DESCRIPTION OF THE DRAWINGS

An embodiment of the present invention will now be described with reference to the accompanying drawings in which.

DETAILED DESCRIPTION OF THE DRAWINGS

Figure 1:
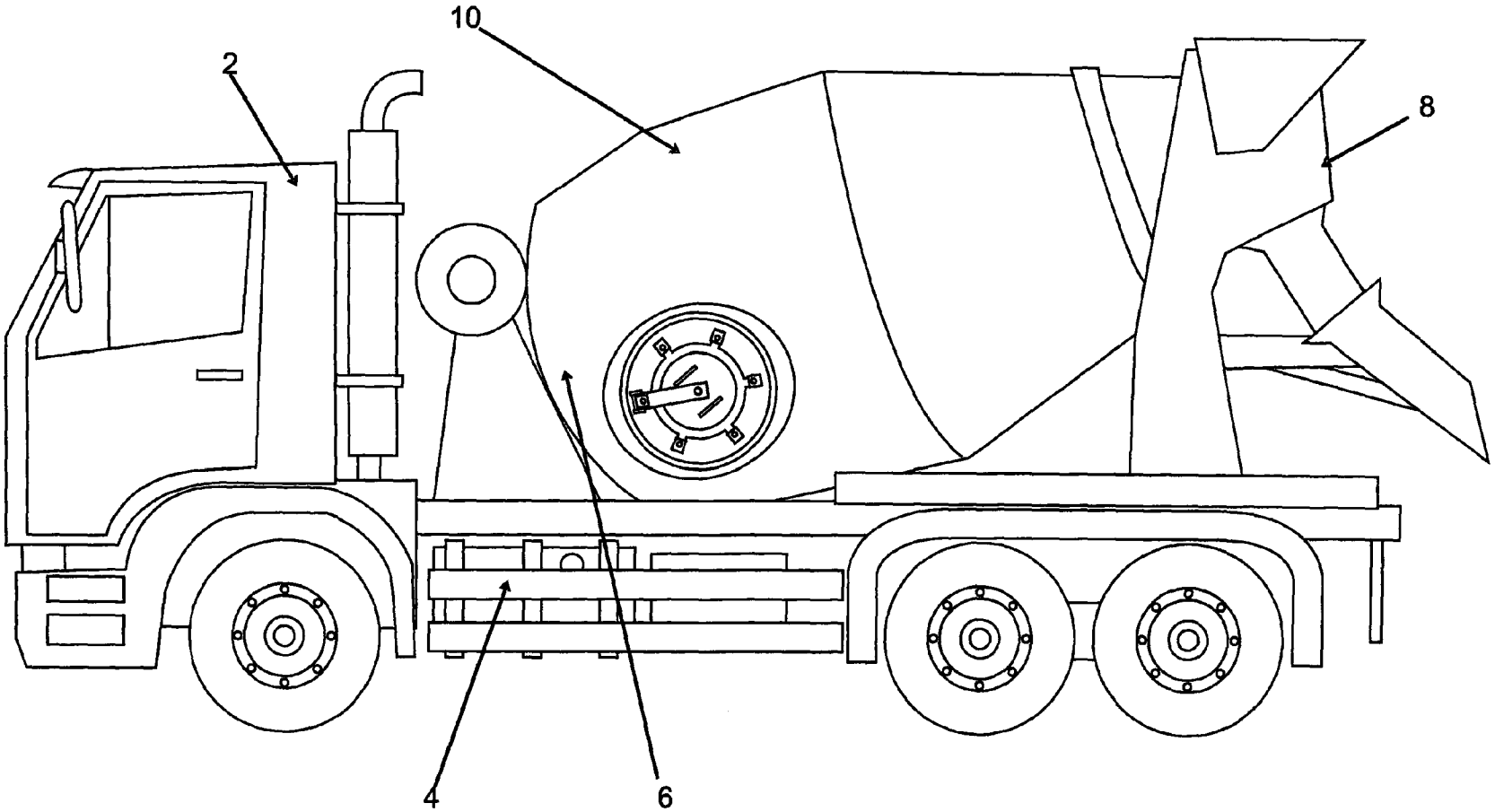
FIG. 1 is a side view of an improved drum for a lorry-based concrete mixer according to an embodiment of the present invention.

Referring to FIG. 1, a side view of an improved drum, generally indicated by reference numeral 10, for a lorry-based concrete mixer 2, the drum 10 is shown mounted to the chassis 4 of the lorry-based concrete mixer 2 with an open end 6 elevated with respect to a closed end 8. The present invention provides access to the closed end 8 without the need to enter the drum 10 through the elevated open end 6.

Figure 2:
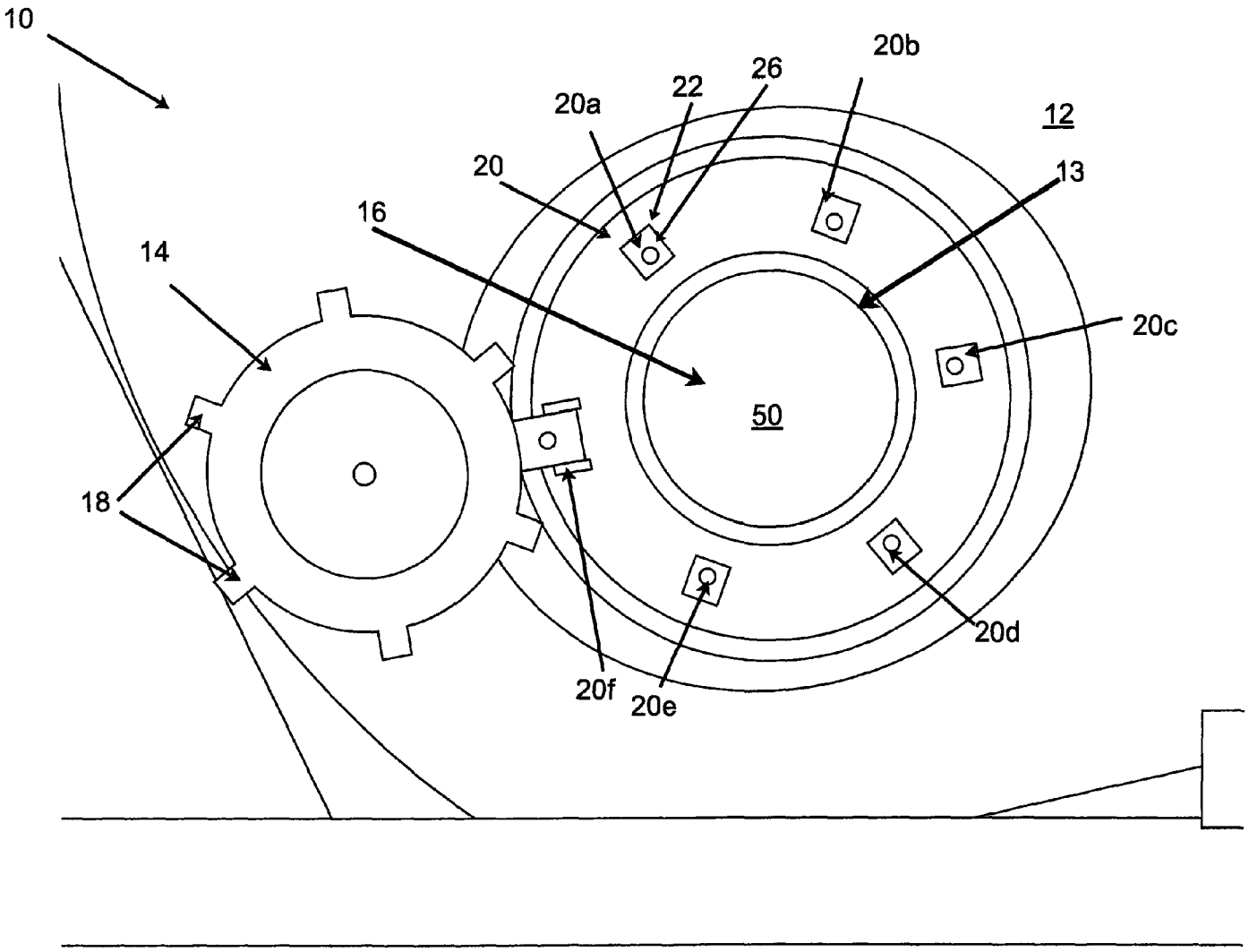
FIG. 2 is an enlarged close up view of part of the drum of FIG. 1 with the manhole cover in the aperture open position.

Referring to FIG. 2, the drum 10 comprises a drum body 12 having an edge 13 defining an aperture 16 for permitting access to a drum body interior 50. The drum 10 further includes a manhole cover 14 hingedly attached to the drum body 12 by means of a hinge 15. The manhole cover 14 is movable from an aperture open position (shown in FIG. 2) to an aperture closed position (shown in FIG. 4).

Mounted to the drum body 12, adjacent the aperture 16, are six locking mechanisms 20*a*-20*f*. Each locking mechanism 20 comprises a tag 22 welded to the drum body 12, and a bolt 26. As will be shown, in the aperture closed position, each bolt 26 is tightened against a lug 18 defined by the manhole cover 14, each bolt 26 pressing a lug 18 against the drum body 12 to form a seal between the manhole cover 14 and the drum body edge 13.

Figure 3:
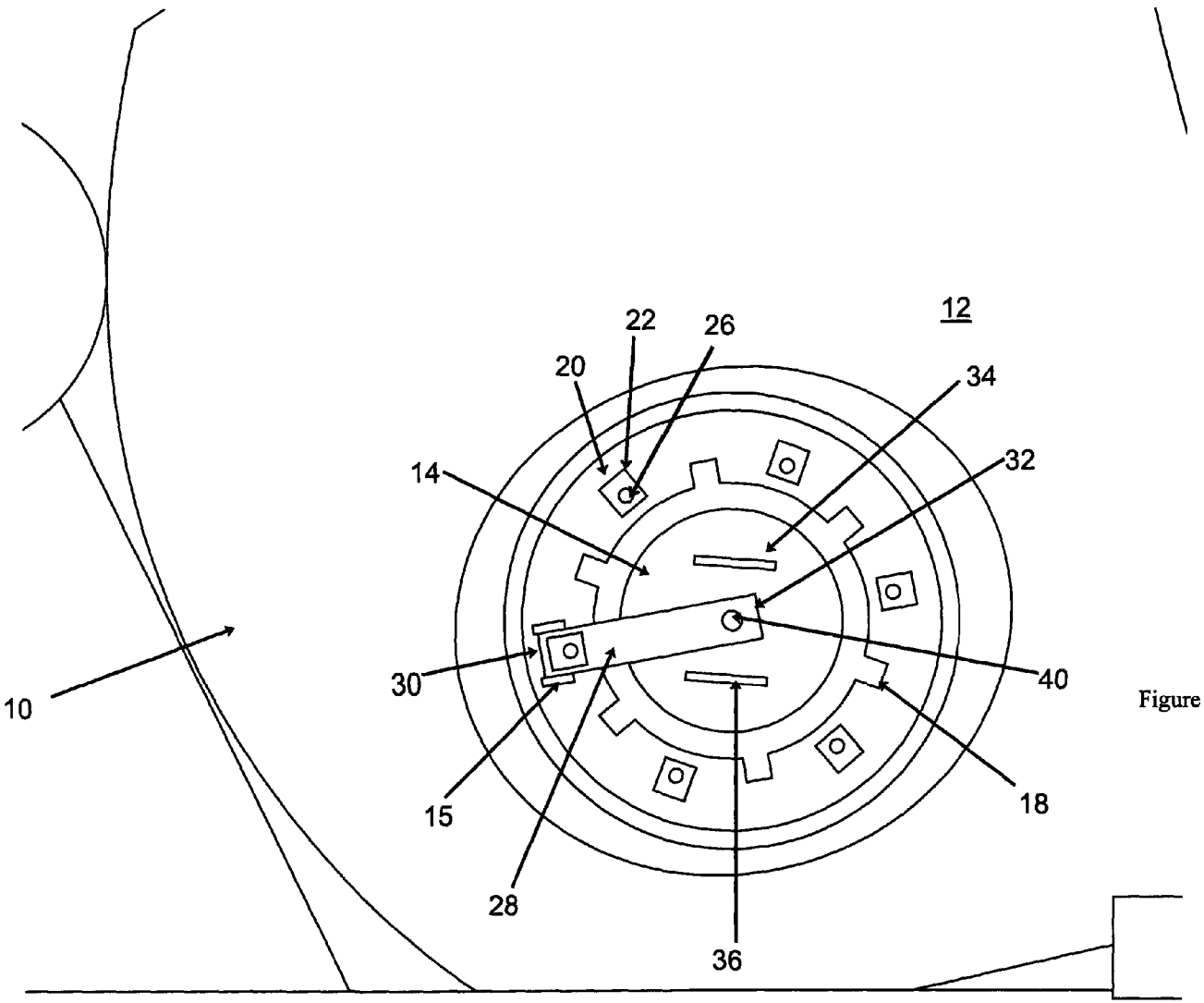
FIG. 3 is an enlarged close up view of part of the drum of FIG. 1 with the manhole cover moved towards the drum.

Referring to FIG. 3, the manhole cover 14 has been swung around the hinge 15 to engage with the drum body 12. It will be seen from this drawing that the hinge 15 comprises an arm 28 connected at a first end 30 to the drum body 12 and at a second end 32 to the manhole cover 14. The arm first end 30, in the position shown in FIG. 3, is lower than the arm second end 32 so that the manhole cover 14 is biased to the open position shown in FIG. 2 due to its weight. A first handle 34 and a second handle 36 are provided on the manhole cover 14 to allow the operator to maintain a firm grip on the manhole cover 14 as, in the position shown in FIG. 3, it will wish to open under its own weight.

Figure 4:
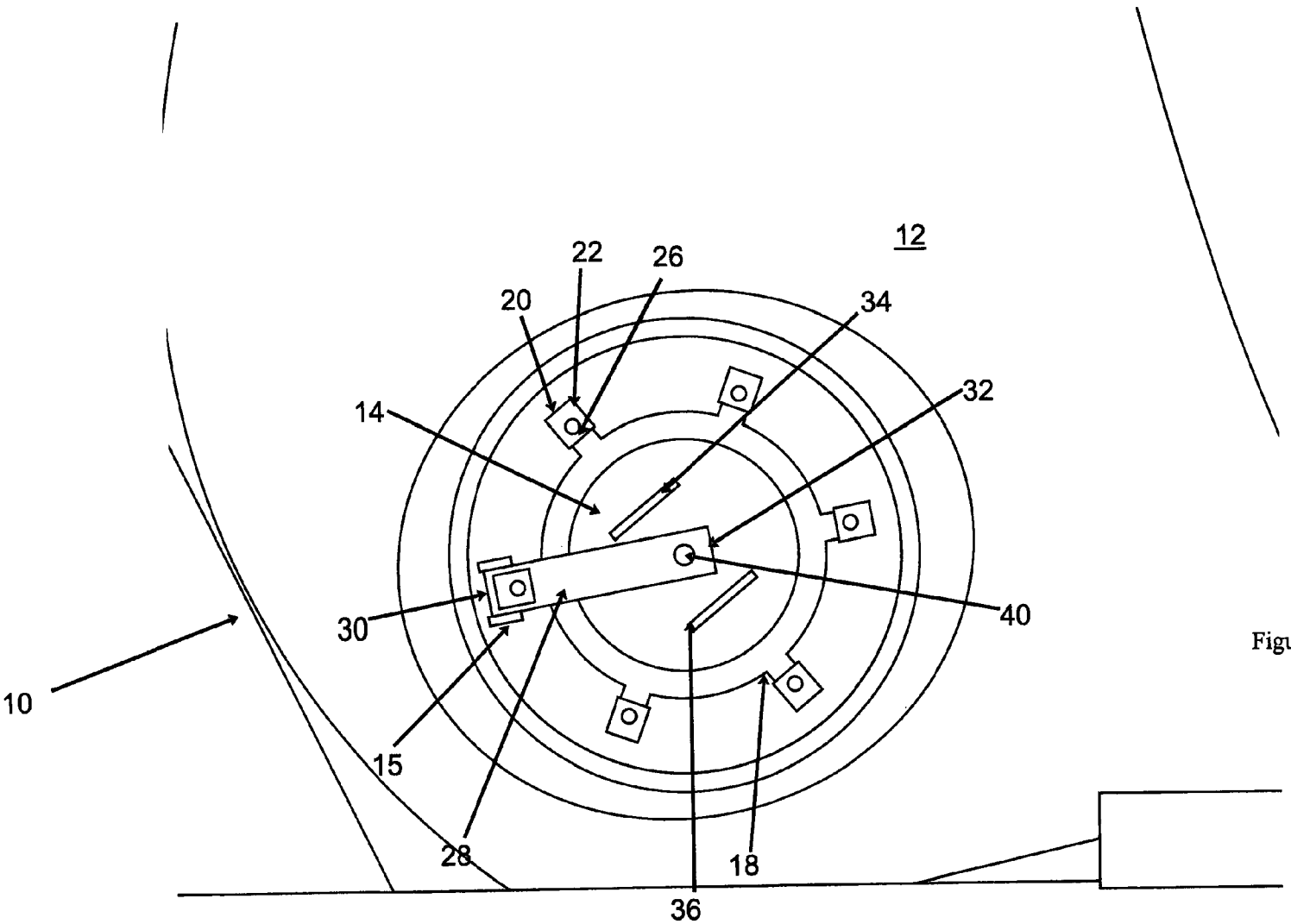
FIG. 4 is an enlarged close up view of part of the drum FIG. 1 with the manhole cover in the aperture closed position.

From the position shown in FIG. 3, the manhole cover 14 is rotated around a bolt 40 which connects the arm second end 32 to the manhole cover 14. The manhole cover 14 is rotated until the lugs 18 are behind the locking mechanisms 20. This position can easily be found by the operator as, as shown in FIG. 4, all that is required is for the manhole cover 14 to be rotated until the first handle 34 engages the arm 18. In moving from the position shown in FIG. 3 to the position shown in FIG. 4, the manhole cover 14 has been rotated anticlockwise. A clockwise rotation would have engaged the second handle 36 with the arm 28 and similarly, in this position, the lugs 18 would be behind the locking mechanisms 20, albeit a lug/locking mechanism combination be different to that shown in FIG. 4.

In the position shown in FIG. 4, the operator can safely release his grip on the handles 34, 36 as the manhole cover 14 will rest against the locking mechanisms 20. To seal the aperture 16, each of the bolts 26 is tightened to sandwich the manhole cover lugs 18 between the locking mechanisms 20 and the drum body 12. In this position a seal is formed between the drum body edge 13 and the manhole cover 14.

To open the aperture 16, the sequence of operations described is reversed. When the bolts 26 are released, the manhole cover 14 is retained by the locking mechanisms 20 permitting the operator to put the tool he has used to slacken the bolts 26 down before taking a grip on the handles 34, 36 and take the weight of the manhole cover 14 before rotating the manhole cover 14 away from the locking mechanisms 20 and allowing it to swing open to the position shown in FIG. 2.

The invention claimed is:

1. An improved lorry-based concrete mixer drum, the lorry-based concrete mixer drum comprising:

a drum body comprising an aperture for permitting access to a drum body interior;

a manhole cover hingedly attached to the drum body adjacent to the aperture, the manhole cover being movable from an aperture closed position, in which position the aperture is sealed, to an aperture open position, in which position the aperture is open and the drum body interior is accessible, wherein one or more edge members are provided on an edge of the manhole cover, and one or more locking mechanisms provided on the drum body adjacent the aperture, wherein the one or more locking mechanisms are operable to retain the manhole cover in a retained position and lock the manhole cover in the aperture closed position, wherein upon rotation of the manhole cover each of the one or more edge members engages with a corresponding locking mechanism such that each of the one or more edge members is trapped between a corresponding locking mechanism and the drum body thereby adopting the retained position in which position the aperture is closed, but not sealed;

wherein interaction of each of the one or more edge members and each corresponding one or more locking mechanisms is operable to support the manhole cover in the retained position, which is an intermediate status of closure between the aperture closed position and the aperture open position.

2. The drum of claim 1, wherein the manhole cover is biased to the aperture open position.

3. The drum of claim 2, wherein manhole cover is biased under its own weight.

4. The drum of claim 1, wherein the manhole cover is adapted to swing open when it is released by the one or more locking mechanisms.

5. The drum of claim 1, wherein in the manhole cover closed position, the one or more locking mechanisms compress the manhole cover against the drum body.

6. The drum of claim 1, wherein in the retained position, the seal between the manhole cover and the drum body is broken.

7. The drum of claim 1, wherein in moving from the aperture closed position to the manhole cover retained position, the manhole cover moves away from the drum body in a direction substantially perpendicular to the drum body.

8. The drum of claim 1, wherein in moving from the manhole cover retained position to the aperture open position, at least part of the movement is a rotational movement.

9. The drum of claim 8, wherein the manhole cover is rotatable to move clear of each of the one or more locking mechanisms.

10. The drum of claim 1, wherein the manhole cover includes handles.

11. The drum of claim 1, wherein the manhole cover is hingedly attached to the drum by an arm.

12. The drum of claim 11, wherein the arm is attached at a first end to the drum body and at a second end to the manhole cover.

13. The drum of claim 12, wherein the manhole cover is rotationally movable with respect to the arm.

14. The drum of claim 1, wherein a tool is required to release the one or more locking mechanisms and allows the manhole cover to move from the aperture closed position to the retained position.

* * * * *